US005218185A

United States Patent [19]

Gross

[11] Patent Number: 5,218,185

[45] Date of Patent: Jun. 8, 1993

[54] ELIMINATION OF POTENTIALLY HARMFUL ELECTRICAL AND MAGNETIC FIELDS FROM ELECTRIC BLANKETS AND OTHER ELECTRICAL APPLIANCES

[75] Inventor: Thomas A. O. Gross, Lincoln, Mass.

[73] Assignee: Trustees of the Thomas A. D. Gross 1988 Revocable Trust, Lincoln, Mass.

[21] Appl. No.: 419,892

[22] Filed: Oct. 11, 1989

Related U.S. Application Data

[63] Continuation-in-part of Ser. No. 393,790, Aug. 15, 1989, abandoned.

[51] Int. Cl.[5] ..... H05B 3/34

[52] U.S. Cl. ..... 219/528; 219/212

[58] Field of Search ..... 219/528, 529, 549, 212, 219/501, 505

[56] References Cited

U.S. PATENT DOCUMENTS

| | | | |
|---|---|---|---|
| 1,972,720 | 9/1934 | Tarpley | 338/61 |
| 2,344,820 | 3/1944 | Kearsley | 219/212 |
| 3,373,262 | 3/1968 | Howell | 219/501 |
| 4,095,228 | 6/1978 | Meinke | 219/522 |
| 4,908,497 | 3/1990 | Hjortsberg | 219/549 |

FOREIGN PATENT DOCUMENTS

| | | | |
|---|---|---|---|
| 2033111 | 5/1980 | United Kingdom | 219/212 |
| 2148633 | 5/1985 | United Kingdom | 219/212 |
| 2168580 | 6/1986 | United Kingdom | 219/212 |

OTHER PUBLICATIONS

Holt, Charles A., Electronic Circuits, ©1978 pp. 812–815.

N.Y. Times, "Scientists Debate Health Hazards . . . ", Jul. 1989.

*Primary Examiner*—Teresa J. Walberg

*Attorney, Agent, or Firm*—William D. Roberson

[57] ABSTRACT

Diverse methods for eliminating potentially harmful periodically varying electrical and magnetic fields which emanate from electric blankets, heating pads, and other electrical appliances intended for use proximate to the human body. One approach entails the use of a self-shielding coaxial cable as the heating element with core and sheath connected electrically in flux-cancelling fashion to minimize emanated magnetic and electrical fields. Another approach involves the use of heating elements, may otherwise be of currently conventional construction, powered with filtered dc to avoid potentially harmful alternating fields and produce harmless stationary fields instead. Ground integrity assurance means are also provided to avoid the emanation from the blanket or appliance of alternating electric fields which might otherwise result from connection to an improperly polarized alternating current source.

5 Claims, 3 Drawing Sheets

ELIMINATION OF POTENTIALLY HARMFUL ELECTRICAL AND MAGNETIC FIELDS FROM ELECTRIC BLANKETS AND OTHER ELECTRICAL APPLIANCES

CROSS REFERENCE TO RELATED APPLICATION

This application is a continuation-in-part and replacement of my prior copending application Ser. No. 07/393,790 filed Aug. 15, 1989, abandoned.

The invention relates to electric blankets and other electrical appliances intended for use proximate to the human body, and to techniques by which potentially harmful emanations of electrical and magnetic fields from such appliances may be minimized.

BACKGROUND

During the past decade, there has been some concern that the alternating electric and magnetic fields in the vicinity of electrical power transmission lines may be carcinogenic or otherwise harmful to humans and animals. For example, there appears to be a greater than expected incidence of leukemia in children living near pole transformers. The cause is believed to be due to a disabling, by the 60 Hz magnetic field, of the body's immune system rather than to initiation of the disease. It is suspected that minute electrical currents, induced by time-varying magnetic fields within the body, could confuse the immune system's ability to recognize cancer cells. The damage done to the immune system is temporary; presumably the immune system becomes effective immediately upon removal of the field. In contrast, the continuous fields generated by dc powered appliances are superimposed upon the Earth's magnetic field by vector addition or subtraction; there is no evidence suggesting harmful biological effects of dc fields of magnitudes comparable to that of the Earth's magnetic field.

The relatively intense ac fields produced by hair dryers and toasters have less effect upon the progress of a disease, because in their typically occasional use the immune system is apparently disabled for only brief periods. Electric blankets are another matter.

Electric blankets and heating pads are particularly pernicious because the body can be so close to potentially harmful periodically varying fields for a substantial portion of one's daily life. A paper by Wertheimer and Leeper entitled "Possible Effects of Electric Blankets and Heated Water Beds on Fetal Development" appearing in *Bioelectromagnetics*, Vol. 7, pp. 13–22 (1986) shows a correlation between the incidence of birth defects and the use of electric blankets.

The patent literature describes numerous means for heat control of electric blankets, but those which I have examined use an open-loop thermostat which senses and acts upon the ambient temperature of the room. The blankets may have embedded thermostats distributed in series with the heater wire, but these do not function unless there is an anomalous "hot spot".

The heating pads which I have examined have embedded thermostats which exert active control. A 4-position switch in the line cord allows the operator the selection of LOW, MEDIUM or HIGH temperature settings. During the "ON" period, heating pads typically draw 0.4 ampere regardless of the setting of the selector switch.

The current drawn by an electric blankets sized for a twin bed is approximately 1.1 ampere (corresponding to 140 watts) during the "ON" period. Thus, due to the difference in magnitude of the currents alone, the resulting magnetic field from an electric blanket is more than double that of a heating pad.

The thermostat and ON-OFF switches used in heating pads and blankets are generally single-pole. This is unfortunate because the entire heating element can float at high line voltage if the line plug is improperly polarized. In this situation, the electric field emanating from the appliance is worse when it is OFF than when it is ON.

The resistive heating element in contemporary blankets and pads is either a helical wire wound over a fiber core or a positive temperature coefficient (PTC) plastic strip bonded along its length to low resistance conductors connected to the power line. Both types of heaters are sheathed with an insulating plastic cover. The resulting cable is distributed in a serpentine configuration. It is the contemporary practice to make the electrical connections to opposite ends of the heater wire for both helical wire and PTC type heating cables. This causes the currents in the conductor wires to flow in the same direction and the stray magnetic field is reinforced.

BRIEF SUMMARY OF THE INVENTION

This invention involves diverse methods for eliminating the harmful electrical and magnetic fields which emanate from electric blankets, heating pads, and other electrical appliances intended for use proximate to the human body. There is a temptation to speak of these as electromagnetic fields. However, at low frequencies the electrical and magnetic components are very loosely coupled in small systems and there is negligible production of photons to constitute electromagnetic radiation. Herein I will adopt the convention of referring to these fields as emanations, rather than radiations.

One method for minimizing these emanations in accordance with the principles of this invention entails the use of an electrically shielded heating element in a flux-cancelling bifilar circuit. Another method according to the invention uses heating elements which may be of prior art construction but which are powered with filtered dc to convert the alternating fields to harmless stationary fields.

INTRODUCTION TO THE DRAWINGS

Figure 7:
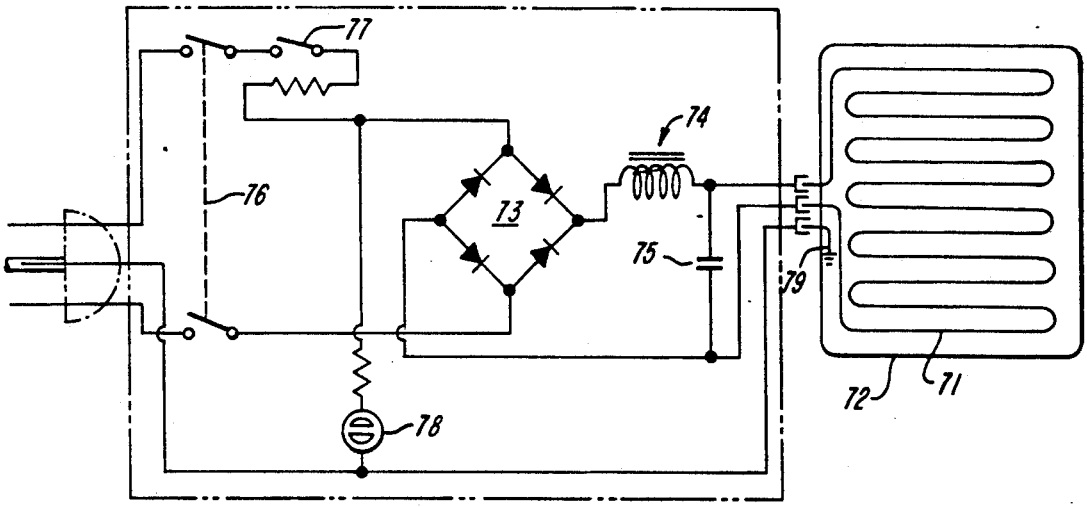
Figure 8:
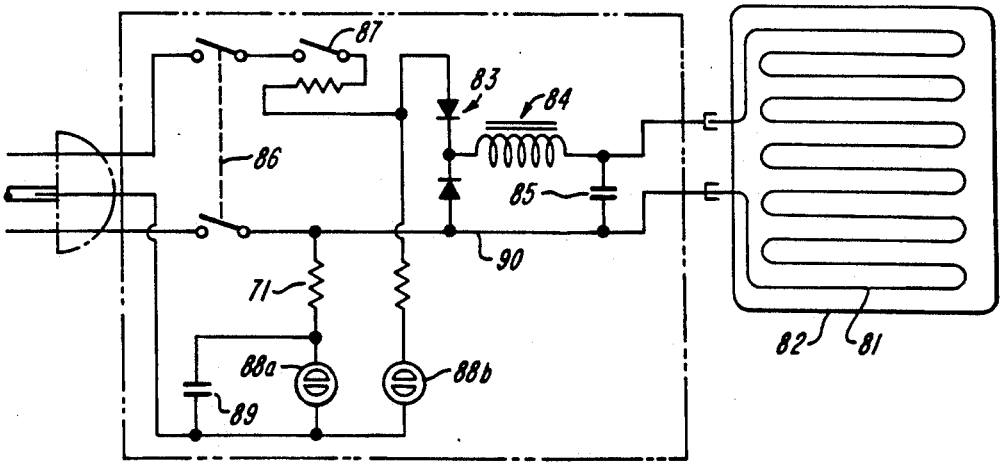

FIG. 7 is a schematic drawing of an electric blanket in accordance with still another embodiment of the present invention employing full-wave rectifier with an LC smoothing filter in its control device; and FIG. 8 is a schematic drawing of an electric blanket employing a down-converter and an LC smoothing filter in its control device in accordance with yet another embodiment of the present invention.

DETAILED DESCRIPTION

Figure 1:
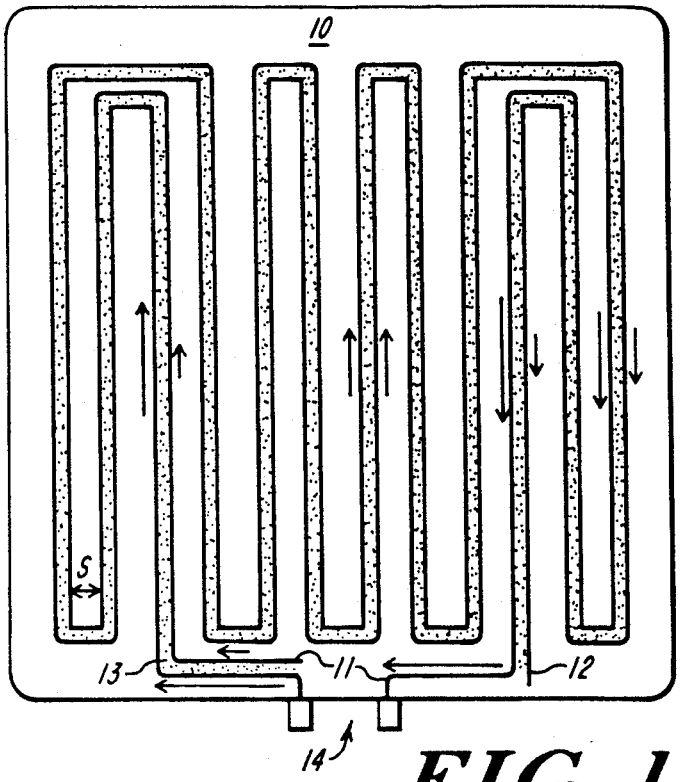
FIG. 1 (PRIOR ART)
FIG. 1 is a drawing representing an electric blanket of a prior art construction in which the heating cable employs a PTC resistance heating material sandwiched between two conductors and electrically connected in a typical manner to produce substantial magnetic flux emanations.

FIG. 1 represents a plan view schematic of an electric blanket 10 with a conventional "twinlead" cable having two low-resistance heater current wires 11, and 12. The ends of the two conductors are presented for excitation by an applied source of alternating current at terminal 14. PTC material 13 separating the two conductors allows electrical current to flow between 11 and 12. The arrows and their lengths indicate the directions of the currents and their relative magnitudes. The separation between cable increments is represented by S. These currents produce magnetic fluxes which are additive. Flux calculations can be made with the Biot-Savart Law by assuming that the pair of wires 11 and 12 is a single conductor carrying the sum of the two currents.

For a single conductor of infinite length:

$$B = \frac{\mu_o i}{2\pi d} \text{ tesla} \qquad \text{[Equation 1]}$$

where:

$\mu_o = 4\pi 10^{-7}$ henries per meter i = amperes (ac and/or dc)

d = distance from current carrying wire in meters (Equation 1 is accurate only when $d << S$; S is typically 5 cm in electric blankets.)

Thus, in the vicinity of each increment of the heating cable in FIG. 1 the vector sum of the excitation current field is additive and substantial magnetic and electrical fields are emanated to influence a body proximate thereto.

Figure 2:
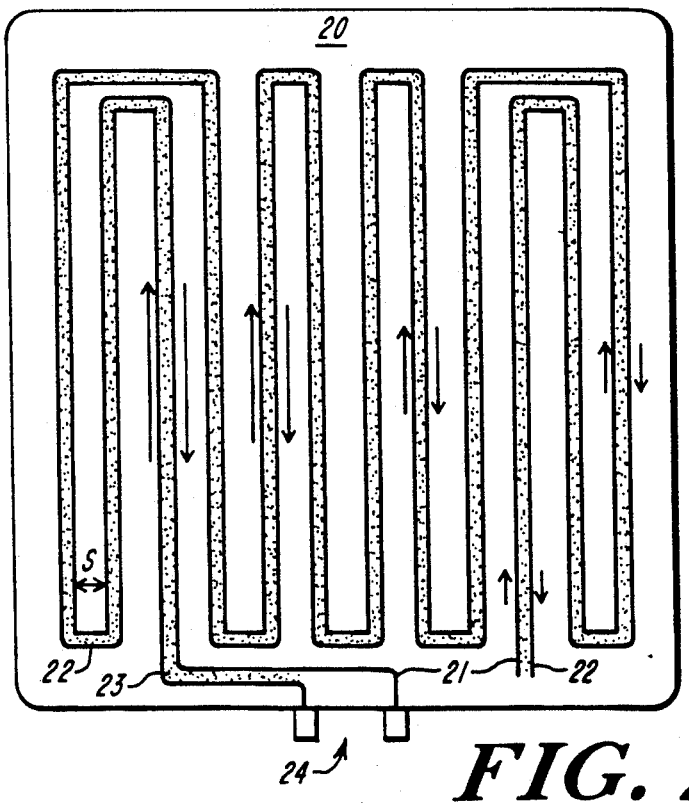
FIG. 2 shows an improved electric blanket with a twinlead PTC heater constructed and connected in accordance with the principles of this invention to prevent substantial flux emanations.

FIG. 2 shows schematically a similar blanket 20 modified in accordance with this invention with both electrical connections made to the same end of the heating cable. As a consequence the currents in conductors 21 and 22, energized by an ac source at terminal 24, are equal and opposing in all parts of the heater cable. Thus, $\Sigma i = 0$ and Equation (1) predicts zero magnetic flux emanating from the heater. This is true in practice when both wires are identically distant from the point where the flux measurement is made. I have made measurements of the flux emanating from a parallel cable made with two 24 AWG conductors spaced 0.21 cm apart. At a mean distance (d) of 1 cm, the stray flux given by this cable in the bifilar circuit of FIG. 1*b* is reduced in the worst case orientation by a factor of 18 (25 decibels) and down to zero when the two conductors are positioned equidistant to the point of measurement.

For a single wire, or the closely spaced pair connected as in FIG. 1, Equation 1 shows that $B = 20\mu$tesla or, in CGS units, 0.2 gauss if $d = 1$ cm and $\Sigma i = 1$ ampere. This value for B is the same for both ac and dc. The Earth's magnetic field is approximately 0.5 gauss; a 120 volt, 120 watt dc powered blanket could modify the Earth's field by 40% in a worst case alignment of the fields. The change in position due to normal tossing and turning by the blanket user will cause Earth's field changes of this order in parts of his body. However, it is not such constant fields, but 50 and 60 hertz ac fluxes of this same magnitude or even smaller which are believed to be a health hazard. The elimination of the periodically varying fluxes which would otherwise be produced by the heating cable of FIG. 1 is an important advantage in the construction of FIG. 2. This bifilar flux-cancelling principle can also be employed with coaxial and twisted-pair heating cables. A grounded electric field shield, as discussed below in connection with FIG. 5, should also be included in such a blanket to minimize the emanation of an alternating electric field.

Some contemporary coaxial heater elements are made with helically wound inner and outer conductors. There is some advantage to be gained in terms of stray longitudinal magnetic flux if the helices are wound in the same direction when the currents flow in opposite directions as in FIG. 2. Ideally the number of turns per unit length of the conductors should be inversely related to their included areas. For example, if the diameters of the helixes are 1 and 2 mm, the pitch of the inner helix should be four times that of the outer helix in order to reduce stray magnetic fields caused by abrupt changes in the lay of the cable. My experiments made to confirm this pitch-area principle indicate that the benefits which can be expected in typical coaxial PTC heaters is in the order of a milligauss.

Figure 3:
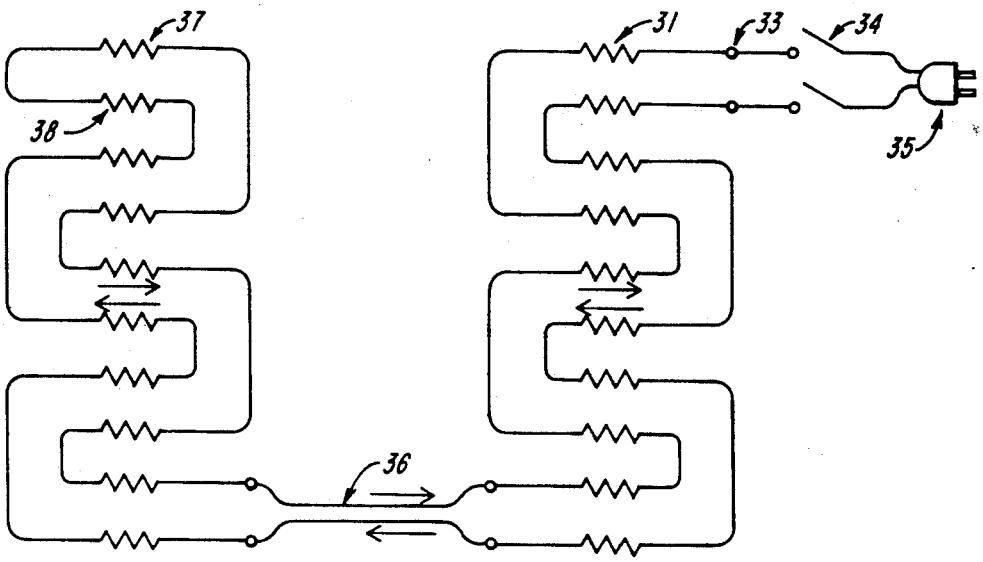
FIG. 3 is a schematic representation of a series connected pair of bifilar heater elements of a toaster interconnected in accordance with this invention.

FIG. 3 depicts an improved bifilar heater element for an electric toaster. Such heater elements are generally made with a nichrome ribbon wound on mica cards. The arrows indicate the direction of current flow which is seen to cause flux cancellation. Contemporary toaster elements may have similar flux cancellation by adjacent nichrome ribbons, but their layouts do not provide for close spacing of the external or interconnecting wiring. My measurements indicate that the wiring joining the power cord to the thermostat, switch, and heater elements is the major source of an external magnetic field. I observed that the maximum magnetic field emanating from one currently popular commercially available toaster occurs off the rear end, a region where the contribution by the ribbon-wound cards is at a minimum. At a distance of 12 cm the flux was 6.4$\mu$tesla. This would appear to be less threatening to health than the fields produced by electric blankets, but the means for reducing this hazard are inexpensive.

FIG. 3 shows how two bifilar elements 31 and 32 can be joined in series without widely spaced wiring which would produce large magnetic fields, by connecting them at adjacent ends 33 to a source of alternating current represented by double-pole switch 34 and plug 35. The remote end of one pair of heater ribbons is connected by two closely spaced conductors 36 to the next pair of heating filaments 37 and 38. In the typical 2-slice toaster a third card is placed in the middle and it is connected in parallel with the line. Again, the wiring to this third card should be closely spaced.

The electric field produced by toasters and portable space heaters can be substantially eliminated by grounding the appliance metal case by means of a 3-wire line cord-plug.

A paper "Electric Field Exposure From Electric Blankets" appearing in *IEEE Transactions on Power Delivery*, April, 1987, reports electric fields in the range of 150–4900 V/m produced by electric blankets on the surface of an ungrounded user. Grounded users may be exposed to electric fields in the range of 1.9–16 kv/m. It is unlikely that the user would be grounded, but in any event, contemporary electric blankets can produce stronger electric fields than are encountered in other situations held in concern. For example, in New York State, the electric field at the edge of the typical hundred-and-fifty foot right of way for a standard 345 kilovolt transmission line is 1.6 kilovolts per meter.

One embodiment of the invention eliminates both the electric field and the magnetic field, which would otherwise exist in the immediate vicinity of the electric blanket, by the use of a particularly configured coaxial electrical heater. In the preferred system depicted in FIG. 4, a blanket 40 encloses a coaxial serpentine heater having an outer conductor 41 connected at one of its ends to the grounded side of the ac power source, and an inner resistance filament 42 connected at the same end to the hot side of the power supply. At its other end to the resistance filament 42 of the heater is shorted to the sheath 41. The outer conductor 41 is made to have a very small resistance compared to that of the inner conductor 42, which can be similar to the heater wire used in conventional electric blankets. The low resistance of the outer conductor insures that its potential is substantially zero because the "hot" inner conductor is electrically shielded. The magnetic field is canceled completely by the equal and opposing currents in every segment of the inner and outer conductors.

Polarized line cord plug 43 cannot be depended upon to insure that the outer conductor of the coaxial heating cable is connected to the ground side of the line, because outlet receptacles are occasionally wired improperly. Proper grounding is so important to safe operation of blanket or pads that an active monitor capable of disconnecting the power line should be considered as a part of the control device. Ground integrity assurance means should preferably be provided to avoid the emanation from the blanket or appliance of alternating electric fields which might otherwise result from connection to an improperly polarized alternating current source.

Figure 4:
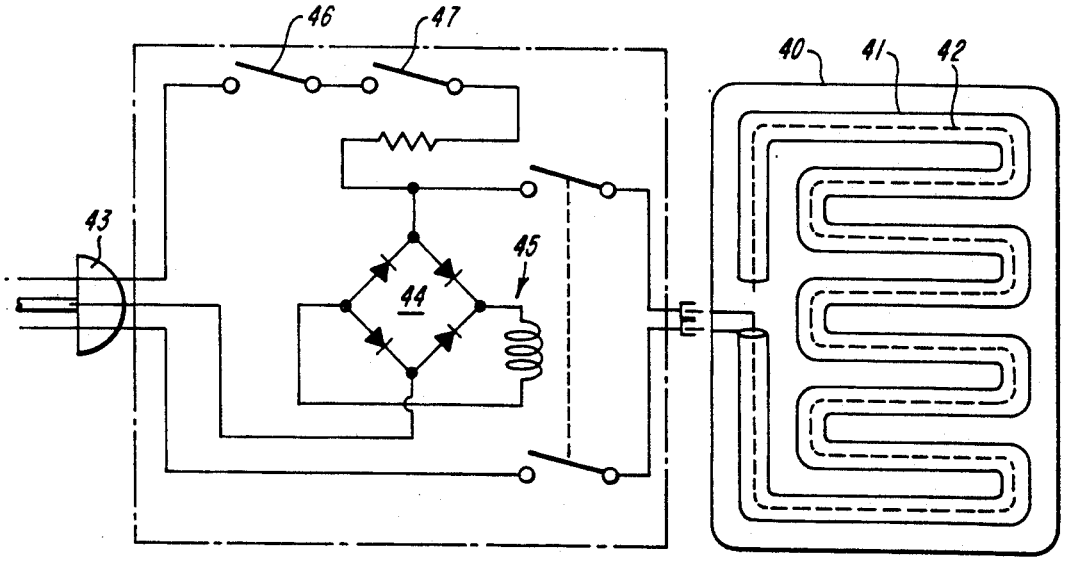
FIG. 4 is a schematic drawing of a preferred embodiment of the present invention employing a coaxial heating element with a grounded sheath and with ground integrity means to insure that the sheath is never connected to the ungrounded side of the power line.

The ground integrity monitor shown in the embodiment of FIG. 4 comprises a combination control device including a full-wave rectifier 44 connected from hot side of the power line to the grounded central terminal of the polarized plug 43 to energize circuit breaker or relay 45. The latter has normally OFF contacts interrupting both sides of the power line. Series connected on-off control switch 46 and thermostat switch 47 complete the energizing circuit. A bridge rectifier 44 is shown driving the dc coil in order that an ac magnetic field be avoided. Direct current relays draw little power but to further minimize loss of energy, the monitor is placed downstream of the blanket controller switches 46 and 47; the standby power is eliminated during the blanket OFF period. If the source of ac current is improperly polarized because the receptacle has been wired improperly, or if connection to the ground pin is absent, the appliance cannot be energized. This avoids the possibility that the improperly polarized condition of the source might convert the sheath 41 of the heater into an electric field emanator. The possibility of electric shock by an electric blanket or heating pad is also eliminated by the coaxial cable of FIG. 4 because the "hot" inner conductor cannot be exposed without its being fused by a short-circuit.

The system of FIG. 4 shares with that of FIG. 8, yet to be described, the need for a correctly polarized line receptacle for safe operation. It may also prove desirable to provide an indicator light, such as shown and described with FIG. 8, to advise the user of the appliance when there is something wrong with the wiring of the power receptacle or source and the source is improperly polarized.

In a modified version of FIG. 4, the short-circuit at the end of the coaxial cable is removed and the space between the inner and outer conductors is filled with PTC material which constitutes the heater element. In this version, both the inner and outer conductors have low resistance in order to achieve a substantially constant voltage drop across the PTC material. Again, the currents in the inner and outer conductors are flux-cancelling because they are equal and opposite in every section of the heater cable.

Figure 5:
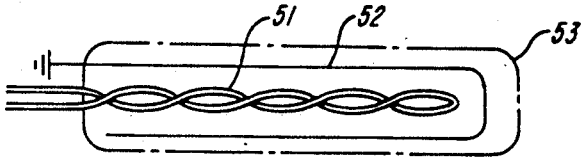
FIG. 5 is a diagrammatic representation of an electric blanket having a twisted filament heater in accordance with another embodiment of the present invention.

Another construction minimizing emanations of periodically varying magnetic and electrical fields is illustrated diagrammatically in the electrical heating pad of FIG. 5 wherein a twisted-pair bifilar heater cable 51 is sandwiched within a grounded electrostatic shield 52 constituting part of the blanket 53. If the twists of the heater wire are tight relative to the distance D to the user, the magnetic field cancellation is substantially complete.

If the wires are not twisted but are still closely spaced as in "twinlead" type PTC cables such as that shown and discussed in connection with FIG. 2, the magnetic field may still be acceptably small, providing of course that a bifilar circuit is used to provide field cancelling current flow.

If the heater wires are sandwiched between grounded conducting foils functioning as an electrostatic shield, the user is not exposed to an electric field. Metallic foils perform electric shielding functions perfectly but they have disadvantages in the blanket/pad application. Foils tend to be noisy, are generally impervious to the passage of water vapor, and would eventually fatigue upon flexing. Fortunately, high conductance is not required for near-perfect shielding.

I calculate the capacitance between a conductor (heating cable) 0.15 cm in diameter and a shield separated by 0.32 cm of material with a dielectric constant of 2, to be approximately 60 picofarads per meter. A large blanket might have more than 30 meters of cable, thus the capacitance on each side of the heater wire to each grounded shield is 2000 pf or 0.002 μfarad. At 60 Hz, the reactance of this capacitance is 1.3 megΩ. The drain current is approximately 0.1 milliamperes per side. The grounded shield can have a resistance on the order of ten-thousand Ω per square without involving a consequential voltage drop. The electric field intensity of a twisted-pair filament is reduced by one-half that of a single wire heater but the capacitance of the heater to the grounded shield may be doubled; the drain current is still in the order of 0.1 milliamperes.

A shield having agreeable "feel" is a 99% cotton muslin sheet woven with 1% graphite fibers. Metallic tinsel could be substituted for graphite. The gaps between the conducting filaments should be smaller than the spacing between the shield and the heater wires. An alternative shield is muslin sparsely impregnated with silver paint; I have not been able to make a satisfactory shield with aluminum paint, presumably because the oxide of aluminum is a good insulator.

Another technique for the elimination of both the alternating magnetic and electrical fields, illustrated in the next three Figures involves the use of filtered dc power in more-or-less conventional blankets and pads; dc power produces stationary electric and magnetic fields. This may be accomplished by rectifying and filtering (smoothing) the rectified voltage.

Epidemiologic evidence is insufficient but it is plausible that ac fields are less hazardous to health as the frequency is removed (either above or below) from the band of brain-wave frequencies (1 Hz to 35 Hz). It is well established that 25 Hz is much more lethal and 400 Hz is much less lethal than 60 Hz. It is plausible that the full-wave rectifier systems—which convert 60 Hz ac to 120 Hz ripple superimposed on dc—will be found somewhat safer even in the absence of filtering.

The most stringent government guideline for permissible whole-body occupational exposure to static (non-alternating) magnetic fields is issued by the U.S. Government Department of Energy. Their limit is 0.01 tesla (100 gauss) for 8 hours and 0.1 tesla (1000 gauss) for 1 hour. Higher fluxes are permitted by CERN [the European Organization for Nuclear Research], the Fermi Laboratory, the Stanford Linear Accelerator Center and the Soviet Union. Nuclear Magnetic Resonance machines, popular for diagnostic imaging, require the patient to be exposed to approximately 2 tesla (20,000 gauss). [See *Biological Effects and Dosimetry of Static and ELF Electromagnetic Fields*, page 670, Plenum Press, 1983.] The worst-case magnetic flux generated by a dc-powered blanket at a distance of 1 cm is shown by Equation 1 to be 20$\mu$ tesla (200 milligauss). I have confirmed this by measurements with a Hewlett-Packard 3529a magnetometer.

The dc electric field is equal in magnitude to the ac field in a conventional blanket running at the same voltage. However, the biological effect of the dc field due to a blanket or heating pad is negligible. Unlike the situation with high-voltage dc transmission lines, no ionization takes place and the air space between the heater wires and the human body has practically infinite resistance. Although the electric fields of an ac powered blanket may have biological consequences because of their displacement currents, no voltage appears across the body due to the dc field; thus no current flows through it.

Figure 6:
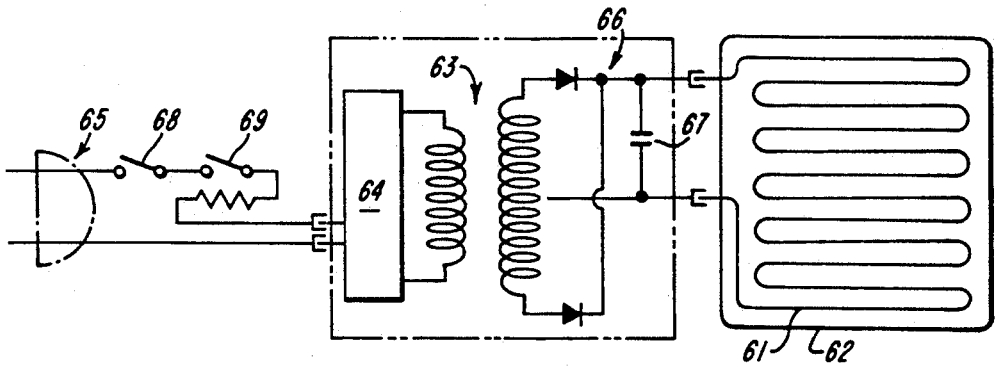
FIG. 6 is a schematic drawing of an electric blanket system employing a a control device combining a high frequency oscillator-rectifier-filter as an accessory to an electric blanket in accordance with another embodiment of the invention.

FIG. 6 represents an electric blanket system in which the heating filament 61 of the blanket 62 is energized with dc current from a power converter which includes an isolation transformer 63 driven by a high-frequency oscillator 64. Oscillator 64 is energized from the ac source represented by plug 65 through control switch 68 and thermostat switch 69. This system is well suited for application to existing appliances; no grounding or shielding is necessary and the heat rate need not be altered. It is the only system described here which provides safe operation without recourse to a 3-prong or polarized line receptacle plug. Various rectifier configurations can be used in connection with the high-frequency isolation transformer system. A center-tap 2-diode rectifier 66 is shown in FIG. 6 with its output filtered by capacitor 67. This rectifier circuit requires 1.5 times the transformer secondary volt-ampere rating needed for a bridge rectifier but the difference in transformer size at high frequency is negligible. A suitable frequency is above the audible (20 kHz) and below that which might cause radio interference (3 MHz). For after-market conversion of existing electric blankets and heating pads a dc source may best be implemented by an off-line high-frequency oscillator driving a rectifier-filter such as this.

FIGS. 7 and 8 depict two transformerless power supplies using an input inductor filter in the control device. The cost of the inductor is an engineering concern; the inductor for a 140-watt appliance may weigh about one-half kilogram. The inductor does not eliminate the need for an electrostatic shield.

In FIG. 7 the filament 71 of the blanket 72 is energized with dc from a full-wave rectifier 73 through a smoothing input filter comprising inductor 74 and shunt capacitor 75. The rectifier 73, connected to the ac source through control switch 76 and thermostat switch 77, delivers a dc voltage of approximately 0.9 times the rms input voltage. The possibility of objectionable heat rate in after market applications, is thus avoided with an inductor input filter. Resistors are not required to limit the currents in the rectifier, because the inductor eliminates the surge of current during start-up.

The inductor 74 has a critical minimum value needed to maintain continuous current and thus avoid transients which would cause voltage stress and radio interference. For 60 Hz systems, $L_{min}=R/1000$ henries, where R is the resistance of the pad or blanket. R for a 120-watt, 120-volt blanket is 120Ω. The critical value of inductance for 60 hertz operation is 0.12 henry. The critical inductance is an inverse function of frequency. If the blanket is to be used on a 120-volt, 50 Hz power source, the critical input inductance is 0.144 henries.

The filter may consist of a large inductor alone without a shunt capacitor, but a suitably low-ripple voltage is more economically obtained with a smaller inductor working with a capacitor or with multiple LC filter sections comprising smaller components. There is a further requirement on the size of the filter elements; the LC product must be large enough to place the resonant frequency of the filter well below the 120 Hz ripple frequency. A minimum LC product of 10$\mu$ farad-henries in each section is good commercial practice for a 60 hertz system.

A rectifier-filter such as that shown in FIG. 7, but without the inductor 74, delivers a dc voltage nearly 40% greater magnitude than the rms value of the ac driving the rectifier. This higher voltage is an advantage when using PTC heaters which may be more easily implemented with materials of higher specific resistance.

The full-wave bridge rectifier 73 shown in FIG. 7 solves the magnetic field problem but requires the shield such as was described above for FIG. 5 to inhibit the electric field. The output of the full-wave bridge can be a smooth ripple-free voltage across the capacitor terminals but both terminals may have the full ac line voltage with respect to ground. The potential to ground of the heating element in the blanket or pad of FIG. 7 rises and falls with the ac line voltage. Hence, although there is no resultant periodically varying magnetic field, the electric field generated by the heater is similar to that of a conventional appliance energized with unrectified ac.

Except for the version described in connection with FIG. 6, all embodiments of this invention shown require a ground and means to insure that appropriate connection is made to it. As mentioned above, ground integrity assurance means should preferably be provided to avoid the emanation from the blanket or appliance of alternating electric fields which might otherwise result from connection to an improperly polarized alternating current source. The electric blanket system shown in FIG. 7 includes an indicator light, neon lamp 78, connected to the receptacle ground and to high side of the power line. This lamp should glow when the blanket is heating. Otherwise the user is alerted that the source is improperly polarized and that the shield 79 is not grounded.

If a transformer isolates the rectifier from the unbalanced line voltage, as in FIG. 6, the dc powered heater can be grounded or left floating and there is no need for electrostatic shielding. Furthermore, the dc voltage could be adjusted to permit the most economical heater wire. Unfortunately, unless the transformer can operate at a high frequency—as in FIG. 6—the cost of the isolation transformers is high; the weight of a 35-watt transformer, suitable for a low power pad, is nearly a kilogram. The weight of a 140-watt transformer required for a typical blanket would be about three kilograms. The size of the transformer varies inversely with frequency; a 50 Hz 140-watt transformer made with ordinary commercial materials would weigh more than three and a half kilograms.

An alternative to the full-wave bridge for an original equipment manufacturer is a buck (step-down) converter as shown in FIG. 8. Here the heating filament 81 of the blanket 82 is energized with filtered and smoothed dc from rectifier 83 through inductor 84 and shunt capacitor 85. This circuit provides a common ground between the ac input and the dc output; thus the need for an electrostatic shield is eliminated. It may be desirable, however, to enclose the entire control device including the dc power supply and control switch within a metallic shield grounded to the ground pin of the electrical plug to prevent the emanation of electrical fields from the control device itself. The dc output voltage is about 35% of the rms ac input. The hazard of electrical shock is thereby greatly reduced. In addition, the heater resistance can be reduced by an order of magnitude with concomitant saving in cost. As in the previously described embodiment, the rectifier 83 is connected downstream of the control switch 86 and thermostat switch 87.

This system—and that shown in FIG. 4—requires a properly polarized line receptacle for safe operation. Lamp 88*a* is part of a relaxation oscillator which pulses about twice per second if line 90 is wired improperly to the high side. Neon glow lamp 88*b* serves the same ground integrity monitoring function as lamp 78 in FIG. 7. The failure of lamp 88*b* to glow and/or the presence of annoying blinking by lamp 88*a* tells the user that use of the appliance with a particular receptacle may be hazardous.

One disadvantage of the system of FIG. 8 is the magnitude of the critical inductance of 84; it is five times that needed for the circuit of FIG. 7, (in order to achieve continuous current, L is greater than R load/200 for 60 Hz), and it is nearly ¾ the size of an isolation transformer for a given power and frequency. However, it is not essential that inductor 84 be as large as the critical inductance; it is likely that the problems brought on by discontinuous current can be solved by means less costly than by a large inductor. Another disadvantage of the down convertor is the ripple frequency which is equal to the line frequency and not multiplied 2× as in the case of full-wave rectification. As mentioned previously, there may be undesirable biological consequences of the lower frequency. In spite of these disadvantages, the down-converter may be particularly useful in low-power appliances such as heating pads where its simplicity and its reduced output voltage may be appreciated. Considerable expense is involved in order to reach the 400Ω needed for a 120 volt, 36-watt heater.

The heating pad circuit of FIG. 8 was constructed with the following components:

Capacitor 85 = 1500 μfarads
Capacitor 89 = 0.2 μfarad
Diodes 88 = 1N4003
Inductor 84 = 0.32 henry, 600 ma.
Resistor 81 = 65Ω
Resistor 91 = 200 KΩ

The following results were obtained with an input of 110 volts, 60 Hz.:

$E_{load}$ = dc 40.95 volts
$E_{load}$ = ac 1.95 volts peak-to-peak, 0.7 volts rms, 60 Hz
$I_{load}$ = dc 0.63 amperes
$W_{load}$ = 25.8 watts In order that the inductor current not be allowed to go to zero and thus cause voltage transients and radio interference, the inductor must be able to store enough energy to feed the load during the half cycle when the line is not delivering power. At the start of that cycle, the inductor current is twice the average current or 1.26 amperes. The energy in the inductor is:

$$\begin{aligned} \text{Energy} &= LI^2/2 \text{ watt-seconds} \\ &= 0.32 \times 1.59/2 \\ &= 0.24 \text{ watt-sec.} \end{aligned} \qquad \text{[Equation 2]}$$

The energy required by the load during the half cycle is: 25.8 watts × 0.008 seconds = 0.21 watt-seconds

Having thus described a number of illustrative embodiments of this invention by means of which the full benefits of electrical blankets and other such electrical appliances intended for utilization proximate to the human body may be obtained without exposing the body to emanations of potentially harmful periodically varying magnetic and electric fields, the invention in its broader aspects should not be limited except by a fair interpretation of the appended claims.

What is claimed is:

1. An electrically heated blanket or pad comprising:
electrical conductors adapted for connection to a source of alternating electrical current;
an electrically energizeable heating element for utilization proximate to the human body; and
a control device interconnecting said heating element with said electrical conductors, said control device comprising a high-frequency oscillator energized from said electrical conductors, and rectifying and filtering means for providing rectified and filtered electrical currents, the output of said oscillator supplying said electrical heating element through said rectifying and filtering means to substantially eliminate low frequency currents through said heating element, thereby to minimize the emanation of low frequency periodically varying magnetic fields from said heating element.

2. The combination of claim 1 wherein the frequency of said oscillator is above 20 kHz and below 3 MHz.

3. The combination of claim 1 wherein said rectifying and filtering means comprise a pair of center-tapped rectifiers across the output of said oscillator and at least one shunt capacitor.

4. An electrically heated blanket or pad comprising:

electrical conductors adapted for connection to a source of alternating electrical current;

an electrically energizable heating element for utilization proximate to the human body; and a control device interconnecting said heating element with said electrical conductors, said control device comprising a high-frequency oscillator for energization by said source of alternating current, a rectifier connected to the output of said oscillator for providing rectified electrical currents to said heating element, and filtering means for smoothing the rectified electrical currents, thereby to minimize the emanation of periodically varying magnetic fields from said heating element.

5. The combination of claim 4 wherein the frequency of said oscillator is above 20 kHz and below 3 MHz.

* * * * *